US005951850A

United States Patent [19]

Ino et al.

[11] Patent Number: 5,951,850

[45] Date of Patent: Sep. 14, 1999

[54] PROCESS FOR FLUID CATALYTIC CRACKING OF HEAVY FRACTION OIL

[75] Inventors: Takashi Ino; Satoru Ikeda, both of Yokohama, Japan

[73] Assignees: Nippon Oil Co., Ltd.; Petroleum Energy Center, both of Tokyo, Japan

[21] Appl. No.: 08/864,472

[22] Filed: May 28, 1997

[30] Foreign Application Priority Data

Jun. 5, 1996 [JP] Japan ..... 8-163624
May 15, 1997 [JP] Japan ..... 9-139102

[51] Int. Cl.[6] ..... C10G 11/05

[52] U.S. Cl. ..... 208/120.01; 208/113; 585/653

[58] Field of Search ..... 208/113, 120, 208/120.01; 595/653

[56] References Cited

U.S. PATENT DOCUMENTS

| | | | |
|---|---|---|---|
| 4,385,985 | 5/1983 | Gross et al. | 208/113 |
| 4,693,808 | 9/1987 | Dewitz | 208/113 |
| 4,797,262 | 1/1989 | Dewitz | 422/142 |
| 4,839,319 | 6/1989 | Schuette et al. | 502/64 |
| 4,980,048 | 12/1990 | Leib et al. | 208/113 |
| 4,980,053 | 12/1990 | Li et al. | 585/653 |
| 5,043,055 | 8/1991 | Owen et al. | 208/113 |
| 5,043,058 | 8/1991 | Forgac et al. | 208/480 |
| 5,324,419 | 6/1994 | Muldowney | 208/120 |
| 5,468,369 | 11/1995 | Muldowney | 208/113 |
| 5,481,057 | 1/1996 | Bell et al. | 585/653 |

FOREIGN PATENT DOCUMENTS

| | | |
|---|---|---|
| 0 305 720 A2 | 3/1989 | European Pat. Off. . |
| 0 369 536 A1 | 5/1990 | European Pat. Off. . |

*Primary Examiner*—Walter D. Griffin
*Attorney, Agent, or Firm*—Kubovcik & Kubovcik

[57] ABSTRACT

A heavy fraction oil is catalytically cracked by contacting the oil with a catalyst containing an ultrastable Y-type zeolite, in a fluid catalytic cracking apparatus having a regenerating zone, a reaction zone, a separation zone and a stripping zone and under conditions that a reaction zone outlet temperature is in a range of 550 to 700° C., a catalyst/oil ratio is in a range of 15 to 100 wt/wt, and a difference between a regenerating zone catalyst concentration phase temperature (1) and the reaction zone outlet temperature (2) is in a range of 5 to 150° C. According to the fluid catalytic cracking process, an amount of dry gases generated by the thermal cracking of the heavy fraction oil can be lessened while a yield of light fraction olefins can be enhanced.

12 Claims, No Drawings

PROCESS FOR FLUID CATALYTIC CRACKING OF HEAVY FRACTION OIL

BACKGROUND OF THE INVENTION

1. Field of the Invention

This invention relates to a process for catalytic cracking of a heavy fraction oil. More particularly, it relates to a fluid catalytic cracking (FCC) process which comprises cracking a heavy fraction oil to obtain olefins which are light fraction oils such as ethylene, propylene, butene and pentene.

2. Prior Art

In a usual catalytic cracking technique, petroleum-derived hydrocarbons are catalytically cracked with a catalyst thereby to obtain gasoline as the main product, a small amount of LPG, a cracked gas oil and the like, and coke deposited on the catalyst is then burnt away with air to recycle the regenerated catalyst for reuse.

In recent years, however, there has been a tendency that a fluid catalytic cracking apparatus is utilized not as an apparatus for producing gasoline but as an apparatus for producing light fraction olefins for use as petrochemical materials. Such utilization of an original fluid catalytic cracking apparatus as an olefin producing apparatus is economically advantageous particularly to an oil refinery in which a petroleum refining factory and a petrochemical factory are highly closely combined.

On the other hand, much attention has been paid to environmental problems, and therefore regulation of the contents of olefins and aromatics in gasoline for automobiles, obligation to add oxygen-containing materials (MTBE or the like), or the like has started to be enforced. In consequence, it can be anticipated that alkylates and MTBE will be increasingly demanded as base materials for high-octane gasoline in place of FCC gasoline and catalytically reformed gasoline. Therefore, it will be necessary to increase the production of propylene and butene which are raw materials for these base materials.

Methods for producing the light fraction olefins by the fluid catalytic cracking of a heavy fraction oil include methods which comprise contacting a raw oil with a catalyst for a shortened time (U.S. Pat. Nos. 4,419,221, 3,074,878 and 5,462,652, and European Patent No. 315,179A), a method which comprises carrying out a cracking reaction at a high temperature (U.S. Pat. No. 4,980,053), and methods which comprise using pentasil type zeolites (U.S. Pat. No. 5,326,465 and Japanese Patent National Publication (Kohyo) No. Hei 7-506389 (506389/95)).

Even these known methods still cannot sufficiently produce light fraction olefins selectively. For example, the high-temperature cracking reaction will result in concurrence of thermal cracking of a heavy fraction oil thereby increasing the yield of dry gases from said oil; the shortened-time contact of a raw oil with a catalyst will be able to decrease a ratio of conversion from light fraction olefins to light fraction paraffins due to its inhibition of a hydrogen transfer reaction, but is will be unable to increase a ratio of conversion of heavy fraction oils to light fraction oils; and, likewise, the use of pentasil type zeolites will only enhance the yield of light fraction oils by excessively cracking the gasoline once produced. Therefore, it is difficult to produce light fraction olefins in a high yield from heavy fraction oils by using each of these known techniques alone.

SUMMARY OF THE INVENTION

An object of this invention is to provide an improved process for the fluid catalytic cracking of a heavy fraction oil, which can produce light-fraction olefins in a high yield while producing a lessened amount of dry gases such as gaseous hydrogen, methane and ethane generated by the thermal cracking (thermocracking) of the heavy fraction oil.

The present inventors intensively studied in an attempt to mainly heighten the yield of light fraction olefins while inhibiting thermal cracking which will produce a large amount of dry gases, in a process for the fluid catalytic cracking of a heavy fraction oil at a high temperature and, as a result, they have found that the object can be achieved by contacting the heavy fraction oil with a catalyst at a high temperature under specific conditions described later. This invention has been achieved on the basis of this finding.

More particularly, the process for the fluid catalytic cracking of the heavy fraction oil according to this invention comprises the step of contacting the heavy fraction oil with the catalyst containing an ultrastable Y-type zeolite, in a fluid catalytic cracking apparatus having a regenerating zone, a reaction zone, a separation zone and a stripping zone and under conditions that a temperature at the outlet of the reaction zone is in a range of 550 to 700° C., a catalyst/oil ratio is in a range of 15 to 100 wt/wt, and a difference [(1)−(2)] between a regenerating zone catalyst concentration phase temperature (1) and the reaction zone outlet temperature (2) is in a range of 5 to 150° C.

This invention will be described below in more detail.

Raw Oil (Feedstock or Charge Stock)

In the fluid catalytic cracking of this invention, a heavy fraction oil is used as a raw oil. The heavy fraction oil used preferably has a boiling point in a range of 250° C. or more at atmospheric pressure. The heavy fraction oils used herein include a straight-run gas oil, a reduced-pressure gas oil, an atmospheric-pressure distillation residue, a reduced-pressure distillation residue, a cracked gas oil, and heavy fraction oils obtained by hydrofining said residues and gas oils. These heavy fraction oils may be used singly or jointly or as a mixture thereof with a minor portion of a light fraction oil.

Apparatus and Process

The fluid catalytic cracking apparatus which can be used in this invention has a regenerating zone (a regenerating tower), a reaction zone (a reactor), a separation zone (a separator) and a stripping zone.

In the reaction zone, the fluid catalytic cracking may be effected within a fluidized bed where the catalyst particles are fluidized with the heavy fraction oil, or may be effected by employing so-called riser cracking in which both the catalyst particles and the heavy fraction oil ascend through a pipe or so-called downflow cracking in which both the catalyst particles and the heavy fraction oil descend through a pipe. In this invention, when an extremely short reaction (contact) time is made to be maintained, the downflow cracking is preferably employed.

The fluid catalytic cracking process of this invention will be detailed. First, in the reaction zone, the heavy fraction oil is continuously brought into contact with the catalyst which is maintained in a fluidizing state, under the following specific operating conditions to crack the heavy fraction oil thereby producing light fraction hydrocarbons mainly comprising light fraction olefins. Then, a mixture of the catalyst and a hydrocarbon gas comprising products (cracked products) obtained by the catalytic cracking and unreacted materials is forwarded to the separation zone, in which most of the catalyst is separated from the hydrocarbon gas. Next, the separated catalyst is forwarded to the stripping zone, in which most of the hydrocarbons comprising the products, the unreacted materials and the like are removed from the catalyst particles. The catalyst on which carbonaceous materials and a portion of heavy hydrocarbons are deposited is forwarded from the stripping zone to the regenerating zone. In the regenerating zone, the catalyst on which the carbonaceous materials and the like are deposited is subjected to oxidation treatment to decrease the amount of the deposits thereby obtaining a regenerated catalyst. This regenerated catalyst is continuously recycled to the reaction zone. In a certain case, the cracked products are quenched just upstream of or just downstream of the separator in order to restrict unnecessary further cracking or excessive cracking.

The "reaction zone outlet temperature" referred to in this invention means an outlet temperature of the reaction zone, and it is a temperature before separation of the cracked products from the catalyst, or a temperature before quenching thereof in case that they are quenched just upstream of the separator. In this invention, the reaction zone outlet temperature is in a range of 550 to 700° C., preferably 580 to 700° C. and more preferably 600 to 680° C. If the reaction zone outlet temperature is lower than 550° C. then the light fraction olefins will be unable to be obtained in a high yield, while if it is higher than 700° C. then the thermal cracking of the heavy fraction oil fed will be noticeable thereby undesirably increasing the amount of dry gases generated.

The "catalyst-concentrated phase temperature in the regenerating zone" referred to in this invention means a temperature measured just before the catalyst fluidized in a concentrated state in the regenerating zone is withdrawn from said zone. In the regenerating zone used in this invention the catalyst-concentrated phase temperature is preferably in a range of 600 to 770° C., more preferably 650 to 770° C. and most preferably 670 to 750° C.

In this invention, the catalyst concentration phase temperature (1) in the regenerating zone is higher than the reaction zone outlet temperature (2), and the difference between (1) and (2) is in a range of 150 to 5° C., preferably 150 to 30° C. and more preferably 100 to 50° C. If this temperature difference is in excess of 150° C., the regenerating zone catalyst concentration phase temperature will rise in case that the reaction zone outlet temperature is fixed, whereby the raw oil fed will be led to contact with the catalyst having a high temperature at the inlet of the reaction zone. In consequence, the thermal cracking of the raw oil will be remarkable thereby undesirably increasing the amount of dry gases produced. On the other hand, the temperature difference of less than 5° C. will result in unreasonably increasing the catalyst/oil ratio thereby to make the regeneration unpractical.

In this invention, a catalyst/oil ratio [a ratio of the amount of the catalyst recycled (ton/hr) to a rate of the raw oil fed (ton/hr)] is in a range of 15 to 100 wt/wt, preferably 25 to 80 wt/wt. If the catalyst/oil ratio is less than 15, the regenerating zone catalyst concentration phase temperature will rise owing to a heat balance, whereby the deactivation of the catalyst is accelerated simultaneously with the raw oil being brought into contact with the catalyst having a high temperature, resulting in that the amount of dry gases generated by the thermal cracking of the raw oil increases undesirably. Furthermore, if the catalyst/oil ratio is more than 100, the amount of the catalyst recycled will undesirably increase and, hence, the capacity of the regenerating zone will undesirably be required to be excessively increased in order to secure a catalyst residence time necessary for the regeneration of the used catalyst in the regenerating zone.

In this invention, although operating conditions of the fluid catalytic cracking apparatus, except those described above, are not particularly restricted, the apparatus can be operated preferably at a reaction pressure of 1 to 3 kg/cm 2G for a contact time of 2 seconds or less. The contact time is more preferably 0.5 seconds or less. The contact time referred to herein means either a time between the start of contact of the raw oil with the regenerated catalyst and the separation of the produced cracked products from the catalyst, or a time between the start of contact of the raw oil with the regenerated catalyst and the quenching in case that the obtained cracked products are quenched just upstream of the separation zone.

In this invention, delta coke (a difference between an amount (wt %) of coke deposited on the catalyst at the outlet of the stripping zone and an amount (wt %) of coke deposited on the catalyst at the outlet of the regenerating zone) is preferably in a range of 0.05 to 0.6 wt %, more preferably 0.1 to 0.3 wt %, of the amount by weight of the catalyst. If the delta coke is more than 0.6 wt %, the regenerating zone catalyst concentration phase temperature will rise owing to a heat balance thereby to accelerate the deactivation of the catalyst simultaneously with bringing the raw oil into contact with the high-temperature catalyst, with the result that the amount of dry gases generated by the thermal cracking of the raw oil undesirably increases. On the other hand, if the delta coke is less than 0.05 wt %, it will disadvantageously be difficult to keep the heat balance of the apparatus.

Catalyst

The ultrastable Y-type zeolite which is contained as an active component in the catalyst used in this invention has a crystal lattice constant of preferably 24.45 Å or less, more preferably 24.40 Å or less and most preferably 24.35 Å to 24.25 Å, and a crystallinity of preferably 90% or more, more preferably 95% or more and most preferably 98% or more. In this connection, the crystal lattice constant of the ultrastable Y-type zeolite is a value as measured in accordance with ASTM D-3942-80. If the crystal lattice constant of the ultrastable Y-type zeolite is more than 24.45 Å, a catalyst containing such a zeolite will be poor in coke selectivity and it will therefore be unable to maintain a low delta coke. Furthermore, if the crystallinity is less than 90%, a catalyst containing such a zeolite will be poor in heat resistance and, therefore, the amount of catalyst consumed will be increased in this case.

The catalyst which is used in this invention contains the ultrastable Y-type zeolite which is the active component, and a matrix which is a substrate material for the zeolite. The matrixes include clays such as kaolin, montmorilonite, halloysite and bentonite, and inorganic porous oxides such as alumina, silica, boria, chromia, magnesia, zirconia, titania and silica-alumina.

The content of the ultrastable Y-type zeolite in the catalyst used in this invention is preferably in a range of 5 to 50 wt %, more preferably 15 to 40 wt %.

The catalyst used in this invention may contain, in addition to the ultrastable Y-type zeolite, a crystalline aluminosilicate zeolite or silicoaluminophosphate (SAPO) each having smaller pores than the ultrastable Y-type zeolite. The aluminosilicate zeolites and the SAPOs include ZSM-5, beta, omega, SAPO-5, SAPO-11 and SAPO-34. The zeolite or the SAPO may be contained in the catalyst particles containing the ultrastable Y-type zeolite, or may be contained in other catalyst particles.

The catalyst used in this invention preferably has a bulk density of 0.5 to 1.0 g/ml, an average particle diameter of 50 to 90 $\mu$m, a surface area of 50 to 350 $m^2/g$ and a pore volume of 0.05 to 0.5 ml/g.

The catalyst used in this invention can be manufactured by a usual manufacturing method. For example, a dilute water glass solution ($SiO_2$ concentration=8 to 13%) is added dropwise to sulfuric acid to obtain a silica sol having a pH value of 2.0 to 4.0. Thereafter, the ultrastable Y-type zeolite and kaolin are added to the whole of this silica sol and they are then kneaded to form a mixture which is then spray dried in hot air of 200 to 300° C. Afterward, the thus obtained spray dried product is washed with 0.2% ammonium sulfate at 50° C., dried in an oven at 80 to 150° C. and then fired at 400 to 700° C. to obtain a catalyst usable in this invention.

DESCRIPTION OF THE PREFERRED EMBODIMENTS

Next, this invention will be described with reference to the following examples and the like, but this invention should not be limited to these examples.

EXAMPLE 1

21,550 g of a dilute solution ($SiO_2$ concentration=11.6%) of JIS No. 3 water glass were added dropwise to 3,370 g of 40% sulfuric acid to obtain a silica sol of pH value 3.0. The whole of the silica sol so obtained was incorporated with 3,500 g of an ultrastable Y-type zeolite (crystal lattice constant=24.28 Å, crystallinity=98%, made by Toso Co., Ltd., HSZ-370HUA) and 4,000 g of kaolin, after which the resulting mixture was kneaded and then spray dried in hot air of 250° C. Afterward, the thus obtained spray dried product was washed with 50 liters of 0.2% ammonium sulfate at 50° C., dried in an oven at 110° C. and then fired at 600° C. to obtain a catalyst A. In this case, the content of the zeolite in the catalyst A is 35 wt %.

This catalyst A was evaluated by the use of an insulating downflow type FCC pilot device. With regard to the scale of the device, the inventory (the amount of catalyst) was 2 kg and the raw oil feed was 1 kg/hr, and with regard to operating conditions, the reaction pressure was 1.0 $kg/cm^2G$, the contact time was 0.4 seconds, the reaction zone outlet temperature was 650° C., the catalyst/oil ratio was 30 wt/wt, and the regenerating zone catalyst concentration phase temperature was 720° C. The raw oil used was a desulfurized VGO produced in the Middle East. Prior to feeding the catalyst A into the device, the catalyst was subjected to steaming at 800° C. for 6 hours with 100% steam in order to bring the catalyst into a pseudo-equilibrium state. The results are shown in Table 1.

EXAMPLE 2

The same catalyst A as in Example 1 was evaluated by the use of the same operating conditions, raw oil, device and manner of pretreatment of catalyst as in Example 1 except that the reaction zone outlet temperature was 550° C., the catalyst/oil ratio was 40 wt/wt, and the regenerating zone catalyst concentration phase temperature was 630° C. The results are shown in Table 1.

Comparative Example 1

A commercially available catalyst OCTACAT (W. R. Grace Co., Ltd.) was evaluated by the use of the same reaction zone outlet temperature and pilot device as in Example 1. The OCTACAT contained a zeolite having a crystal lattice constant of 24.50 Å. Prior to feeding the OCTACAT into the device, the catalyst was subjected to steaming at 800° C. for 6 hours with 100% steam in order to bring the catalyst into a pseudo-equilibrium state. When the reaction zone outlet temperature was 650° C., the catalyst/oil ratio was 10 wt/wt and the regenerating zone catalyst concentration phase temperature was 820° C. Furthermore, the raw oil, reaction pressure and contact time employed were the same as in Example 1. The results are shown in Table 1.

Comparative Example 2

The same catalyst A as in Example 1 was evaluated under operating conditions that the reaction zone outlet temperature was 550° C., the catalyst/oil ratio was 12 wt/wt, and the regenerating zone catalyst concentration phase temperature was 680° C. In this case, the raw oil, device, manner of pretreatment of catalyst, reaction pressure and contact time were the same as in Example 1. The results are shown in Table 1.

Comparative Example 3

A catalyst B was prepared following the same procedure as in Example 1 except that the ultrastable Y-type zeolite as used in Example 1 was contained in a proportion of 70 wt % in the resulting catalyst.

This catalyst B was evaluated by the use of the same device as in Example 1. With regard to operating conditions, the reaction pressure was 1.0 $kg/cm^2G$, contact time was 0.4 seconds, reaction zone outlet temperature was 650° C., catalyst/oil ratio was 12 wt/wt, and regenerating zone catalyst concentration phase temperature was 810° C. The results are shown in Table 1.

Comparative Example 4

The same catalyst A as in Example 1 was evaluated by the use of the same operating conditions, raw oil, device and manner of catalyst pretreatment as in Example 1 except that a reaction zone outlet temperature was 500° C., a catalyst/oil ratio was 37 wt/wt, and a regenerating zone catalyst concentration phase temperature was 610° C. The results are shown in Table 1.

TABLE 1

| | Examples | | Comparative Examples | | | |
|---|---|---|---|---|---|---|
| | 1 | 2 | 1 | 2 | 3 | 4 |
| Catalyst | A | A | OCTACAT | A | B | A |
| Reaction zone outlet temp. ° C. | 650 | 550 | 650 | 550 | 650 | 500 |
| Regenerating zone catalyst-concentrated phase temp. ° C. | 720 | 630 | 820 | 680 | 810 | 610 |
| Catalyst/oil ratio wt/wt | 30 | 40 | 10 | 12 | 12 | 37 |
| Conversion rate wt % of raw oil to cracked products | 86.5 | 87.2 | 85.2 | 64.3 | 84.2 | 80.2 |
| Yields wt % | | | | | | |
| dry gases ($H_2$, $C_1$, $C_2$) | 12.2 | 1.9 | 18.8 | 2.1 | 18.5 | 1.3 |
| propylene | 13.6 | 9.3 | 11.1 | 4.2 | 11.0 | 6.9 |
| butene | 15.7 | 16.4 | 10.6 | 5.8 | 10.2 | 11.9 |
| propane, butane | 1.3 | 4.7 | 1.9 | 2.5 | 1.5 | 6.0 |
| gasoline ($C_5$: bp 204° C.) | 36.8 | 49.5 | 35.4 | 43.2 | 35.8 | 49.7 |
| LCO (bp 204–343° C.) | 8.1 | 8.8 | 8.8 | 16.5 | 9.1 | 12.7 |
| HCO (bp more than 343° C.) | 5.4 | 4.0 | 6.0 | 19.2 | 6.8 | 7.1 |
| coke | 6.9 | 4.4 | 7.4 | 3.5 | 7.2 | 4.3 |
| Delta coke wt % | 0.23 | 0.11 | 0.74 | 0.29 | 0.6 | 0.12 |

*$C_1$: methane gas, $C_2$: ethane gas, LOC: Light Cycle Oil and HCO: Heavy Cycle Oil.

It is apparent from the above-mentioned results that when the thermal cracking of heavy fraction oils is carried out under conditions that the reaction zone outlet temperature is high and the catalyst/oil ratio is high, the amount of dry gases such as hydrogen gas, methane gas and ethane gas generated by the thermal cracking of the raw oil will be lessened while the yield of light fraction olefins will be high.

According to the process of this invention for fluid catalytic cracking of a heavy fraction oil, the amount of dry gases generated by the thermal cracking of the heavy fraction oil can be lessened while the yield of light fraction olefins can be heightened.

What is claimed is:

1. A process for the fluid catalytic cracking of a heavy fraction oil selected from the group consisting of a straight-run gas oil, a reduced-pressure gas oil, an atmospheric-pressure distillation residue, a reduced-pressure distillation residue, a cracked gas oil, heavy fraction oils obtained by hydrofining said residues and gas oils, and a mixture thereof, which comprises the step of contacting for a catalyst-oil contact time of up to 2 seconds the heavy fraction oil with a catalyst containing an ultrastable Y-type zeolite having a crystal lattice constant of up to 24.45 Å and a crystallinity of not less than 90%, in a fluid catalytic cracking apparatus having a regenerating zone, a downflow-type reaction zone, a separation zone and a stripping zone and under conditions that a reaction zone outlet temperature is in a range of 550 to 700° C., a catalyst/oil ratio is in a range of 15 to 100 wt/wt, and a temperature (1) of the catalyst-concentrated phase in the regenerating zone is in a range of 30 to 150° C. greater than a temperature (2) of the outlet of the reaction zone.

2. The process according to claim 1 wherein the reaction zone outlet temperature (2) is in a range of 580 to 700° C.

3. The process according to claim 1 wherein the catalyst-concentrated phase temperature (1) in the regenerating zone is in a range of 600 to 770° C.

4. The process according to claim 1 wherein the catalyst/oil ratio is in a range of 25 to 80 wt/wt.

5. The process according to claim 1 wherein the fluid catalytic cracking apparatus is operated at a reaction pressure of 1 to 3 $kg/cm^2G$.

6. The process according to claim 1 wherein the catalyst has a delta coke of from 0.05 to 0.6 wt % of the weight of the catalyst.

7. The process according to claim 1 wherein the crystal lattice constant is up to 24.40 Å.

8. The process according to claim 1 wherein the crystallinity is not less than 95%.

9. The process according to claim 1 wherein the catalyst further contains a clay or inorganic porous oxide matrix selected from the group consisting of kaolin, montmorillonite, halloysite, bentonite, alumina, silica, boria, chromia, magnesia, zirconia, titania and silica-alumina.

10. The process according to claim 1 wherein the catalyst contains the ultrastable Y-type zeolite in an amount of 5 to 50 wt %.

11. The process according to claim 9 wherein the catalyst further contains a crystalline aluminosilicate zeolite or a silicoaluminophosphate (SAPO) each having smaller pores than the ultrastable Y-type zeolite has, the aluminosilicate zeolite or SAPO being selected from the group consisting of ZSM-5, beta zeolite, omega zeolite, SAPO-5, SAPO-11 and SAPO-34.

12. The process according to claim 1 wherein the catalyst has a bulk density of 0.5 to 1.0 g/ml, an average particle diameter of 50 to 90 $\mu$m, a surface area of 50 to 350 $m^2/g$ and a pore volume of 0.05 to 0.5 ml/g.

* * * * *